United States Patent [19]

Stirbis

[11] Patent Number: 4,840,138

[45] Date of Patent: Jun. 20, 1989

[54] FLUID DISPENSING SYSTEM

[75] Inventor: James S. Stirbis, Littleton, Colo.

[73] Assignee: Preferred Machining Corporation, Englewood, Colo.

[21] Appl. No.: 945,515

[22] Filed: Dec. 23, 1986

[51] Int. Cl.[4] ..... B05C 5/02

[52] U.S. Cl. ..... 118/694; 118/409; 141/145; 141/198

[58] Field of Search ..... 118/409, 318, 319, 694; 425/809; 141/145, 198; 222/537

[56] References Cited

U.S. PATENT DOCUMENTS 3,053,221 9/1962 Heffley et al. ..... 425/809 X 4,262,629 4/1981 McConnellogue et al. .... 118/318 X

*Primary Examiner*—John P. McIntosh

*Attorney, Agent, or Firm*—Klaas & Law

[57] ABSTRACT

A sealant supply system for a sealant applying machine having a plurality of rotatable sealant applying head devices rotatable about a central axis of rotation and comprising support means for supporting the system on the machine; a rotatable sealant supply chamber means mounted on the support means for holding a supply of sealant material and having a bottom wall portion, a side wall portion, and an upper wall portion; coupling passage means in a lower portion of the chamber means for connection to the sealant applying head means to supply sealant thereto; a spindle means mounted on the upper wall portion of the chamber means for enabling rotation of the chamber means; a first central passage means in the spindle means enabling supply of air and sealant to the chamber means; bearing journal means and bearing means on an outer wall portion of the spindle means for rotatably supporting the spindle means; a non-rotatable housing means for receiving and rotatably supporting the bearing means and the spindle means; a second central passage means in the non-rotatable housing means for connection to the first central passage means for enabling supply of air and sealant to the chamber means; passage sealing means between the spindle means and the housing means for sealing the first central passage means relative to the second central passage means; a sealant delivery tube means mounted in the first central passage means and the second central passage means and having a discharge opening located in the chamber means for supplying sealant to the chamber means; and air passage means circumjacent the tube means and defined by the tube means and the first central passage means and the second central passage means for supplying pressurized air to the chamber means.

12 Claims, 4 Drawing Sheets

FLUID DISPENSING SYSTEM

BACKGROUND

This invention relates generally to a system for dispensing fluids, and more particularly to a sealant delivery system and apparatus for application of a sealant compound material to can lids of the type disclosed in U.S. Pat. No. 4,262,629, the disclosure of which is incorporated herein by reference.

In general, the apparatus of U.S. Pat. No. 4,262,629 comprises a rotary can lid feed mechanism having a series of pockets which are advanced through a downstacker area to laterally shift each lowermost lid in succession of the stack of lids along an arcuate guide path into each of a series of shallow recesses formed in a rotary chuck table. The rotary chuck table has a series of lift chucks disposed in normally lowered position beneath the recesses, and a rotary drive is operative to synchronously rotate the table and lift chucks at a predetermined rate of speed. A cam member located in the path of travel of the lift chucks is operative to advance each lift chuck in succession when it is received at a first station between a normally lowered position and a raised position through a distance corresponding to two stations, after which the lid is lowered as it is advanced to a third station and discharged into a collection area. The empty recess then continues through a distance corresponding to three more stations before it picks up another can lid. An upper sealant gun assembly includes a spring-loaded chuck aligned with each recess to as to be engageable with each lid as it is raised by the lift chuck to activates an associated sealant gun in response to such engagement. The sealant is discharged from the gun as the can lid is caused to rotate about its own axis by rotation of the lift chuck through the first two stations so as to uniformly deposit the lining material into the groove of each can lid in succession. Again, following application of the sealant, the can lid is lowered by the lift chuck, then disengaged so as to permit the can lid to be discharged from the table preferably by the rotary speed of rotation of the table into a discharge or collection area. Feed interrupt mechanism is provided for interrupting advancement of the can lids from the downstacker area in passing in the event of misalignment of a lid; also, an interrupt mechanism is provided in association with the sealant gun to interrupt delivery of sealant in the event that the can lid is not properly aligned with respect to a recess on the chuck table. Preferably, both interrupt mechanisms are controlled by a common sensor in the rotary feed mechanism; however, a separate sensor is provided on the upper chuck assembly to interrupt supply of sealant. Apparatus of this type has been successfully employed with sealant material made from a non-abrasive, non-corrosive solvent base compound which does not present any significant problems in the sealant delivery system. However, the sealant delivery system of this type of apparatus has been found to be unsatisfactory for an abrasive corrosive water-based sealant compound.

SUMMARY OF INVENTION

A primary object of the present invention is to provide a new and improved sealant delivery system which is suitable for use with a corrosive abrasive electrically-conductive, water-base sealant compound.

Another object is to provide a construction and arrangement in which the sealant passages are separated from the main support structure and, in particular, from the bearing means which rotatably support a sealant supply chamber.

Another object is to provide a closed sealant delivery system to avoid any possible contamination or leakage of the sealant material.

Another object is to reduce wear and cost of construction of the apparatus.

Another object is to provide an automatic sealant delivery system which employs electrical sensor means to sense the level of sealant in the sealant supply chamber and automatically periodically refill the sealant supply chamber.

Another object is to provide pressurized air to the sealant supply chamber in a new and improved manner while also providing a new and improved sealing means between rotating parts of the apparatus.

The present invention provides a sealant dispensing system for use with a conventional rotary-type sealant-applying machine wherein a plurality of circumferentially spaced sealant supply hose means connect a sealant supply means to a plurality of circumferentially spaced sealant dispensing head means which rotate about a central axis of rotation. The sealant supply mean is located in coaxial relationship with the central axis of rotation and rotates thereabout and comprises an elongated vertical rotatable supply chamber means in which a supply of sealant is maintained under pressure by a supply of compressed air for delivery to the sealant dispensing head means through the supply hose means.

A spindle means is attached to the supply chamber means for rotation therewith and extends into a non-rotatable support housing with bearing means mounted therebetween. The support housing means and the spindle means have coaxial aligned central passages which are coaxial with the central axis of rotation. Sealing means are mounted between the spindle means and the support housing means to prevent escape of air from the air passage means. Sealant is delivered to the supply chamber means through a non-rotatable central tubular passage means mounted in the housing and spindle passage means in coaxial alignment with the central axis of rotation. Air is delivered to the supply chamber means through an annular passage means circumjacent the tubular passage means. Electrical sensing means are provided to monitor the amount of sealant in the supply chamber means and to cause additional amounts of sealant to be automatically delivered to the supply chamber when a lower chamber level of sealant is detected and to terminate delivery when an upper maximum sealant level is reached. The sensing means are activated by contact with the conductive water-base sealant compound. The construction and arrangement is such that the sealant does not contact any part of the spindle means nor the support housing means nor the bearing and sealing means associated therewith.

BRIEF DESCRIPTION OF DRAWING

An illustrative and presently preferred embodiment of the invention is shown in the accompanying drawing in which.

DETAILED DESCRIPTION

Figure 1:
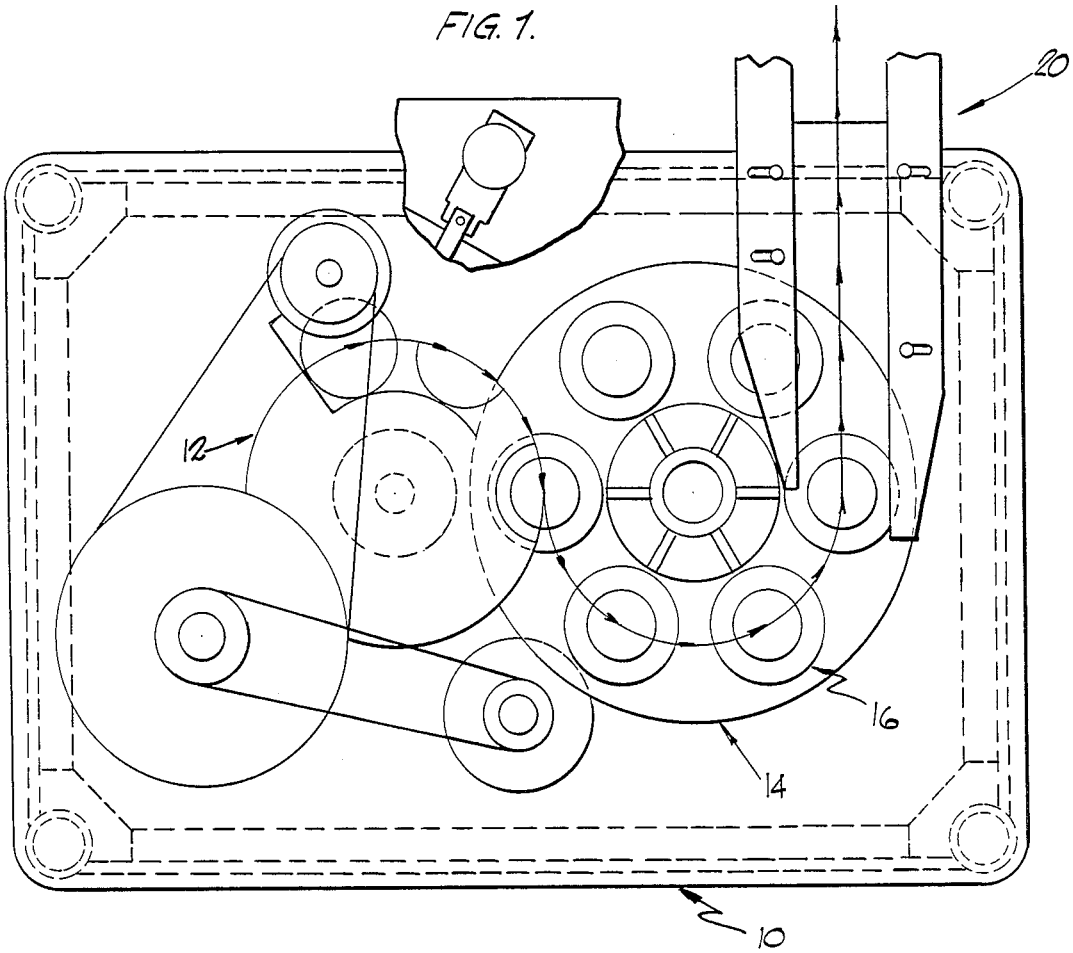
FIG. 1 is a plan view of the prior art apparatus.
Figure 2:
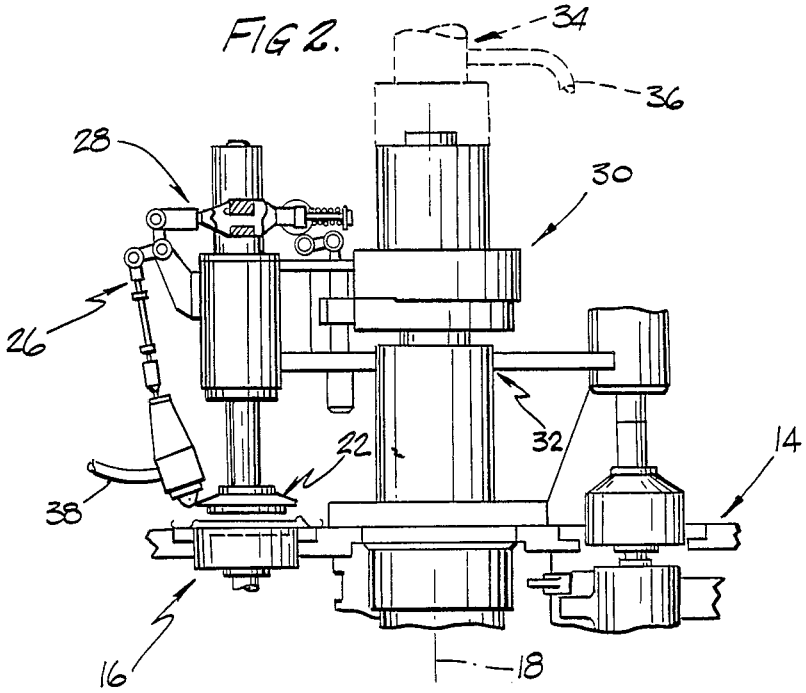
FIG. 2 is a partial enlarged side elevational view of the apparatus of FIG. 1.

In general, FIGS. 1 & 2 show a conventional can lid sealant applying machine 10 which comprises a rotatable star wheel feed means 12 for transferring can lids to a rotatable support wheel means 14 for supporting a plurality of circumferentially spaced lid support means 16 for rotation about a central axis of rotation 18 to a discharge track means 20 for removal of can lids after sealant has been applied thereto.

FIG. 2 shows the conventional sealant applying means which comprises a plurality of circumferential spaced lid holding means 22 for holding the lids on support means 16 and associated sealant applying mean 24 for applying sealant to the lids during rotation of the lid support means 16. Each sealant applying means 24 has a linkage means 26 for controlling position of and supply of sealant to sealant applying means 24. The sealant applying means 24 and associated means are mounted on rotatable bracket means and hub means 30, 32 for rotation about central axis 18. A sealant supply chamber means 34 suitably mounted on bracket hub means 30, 32 is connected to each sealant supply means 24 through suitable supply hose means 36, 38.

Figure 3:
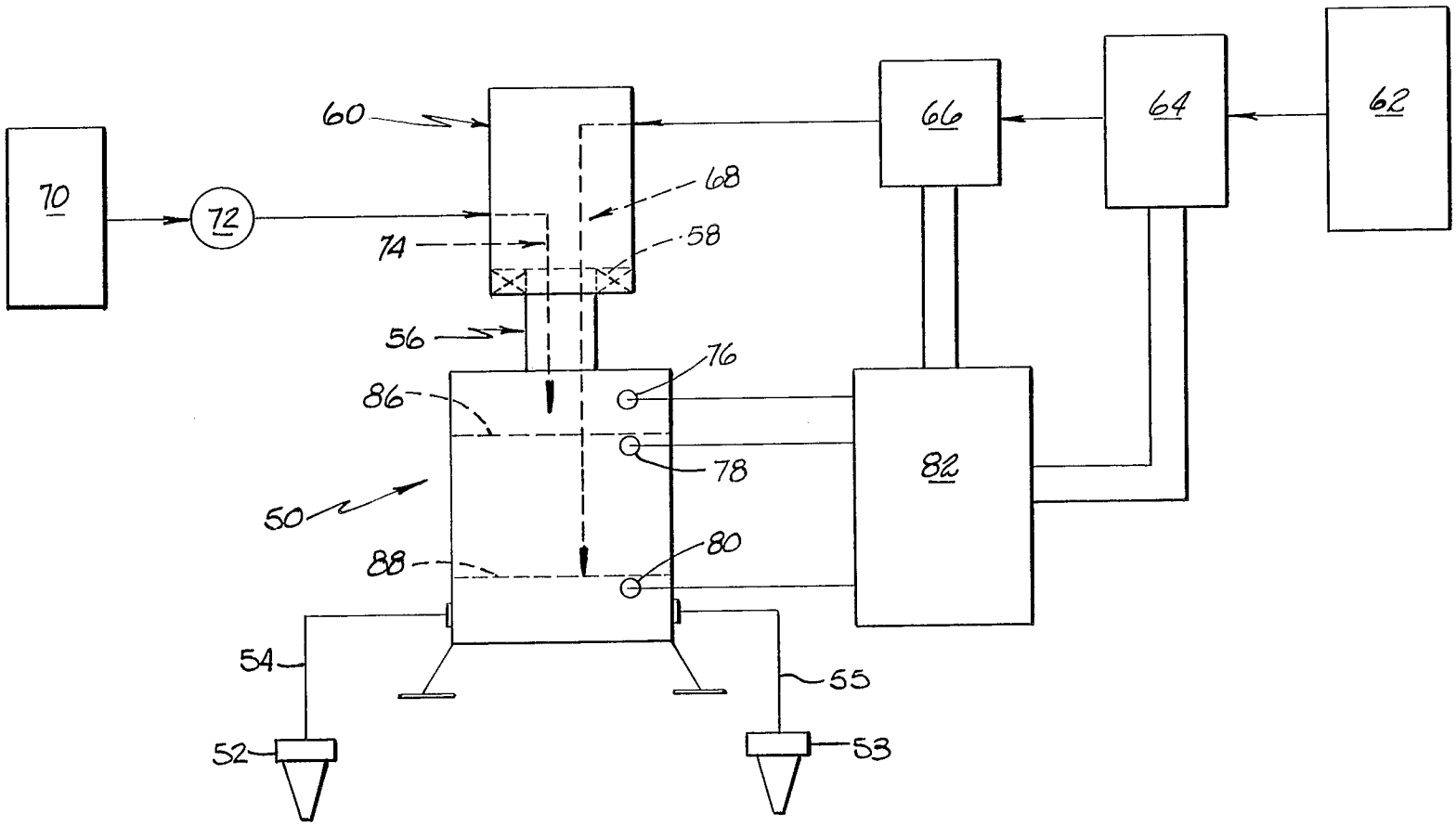
FIG. 3 is a schematic view of the system of the present invention.

As shown schematically in FIG. 3, the sealant delivery system of the present invention comprises a rotatable sealant supply chamber means 50 for holding a supply of sealant for delivery to one or more conventional dispensing head means 52, 53 through conventional supply hose means 54, 55. A spindle means 56 and conventional bearing means 58 enable rotation of supply chamber means 50 relative to a conventional non-rotatable support housing means 60. Sealant is periodically supplied to supply chamber means 50 from a large-size supply container means 62 through a conventional pump means 64, a conventional solenoid valve means 66 and supply tube means 68 mounted in and extending through support housing means 60 and spindle means 56 into supply chamber means 50. Pressurized air is continuously supplied to sealant supply chamber means 50 from a conventional air supply source 70 through a conventional pressure regulator means 72 and supply passage means 74 in and extending through spindle means 56 and support housing means 60 to chamber means 50. Three level sensor means 76, 78, 80 are mounted in sealant supply chamber means 50 and connected to a conventional electrical control means 82 which controls pump means 64 and solenoid valve means 66 to maintain a supply of sealant in the chamber means 50 between a maximum level 86 and a minimum level 88.

Figure 4:
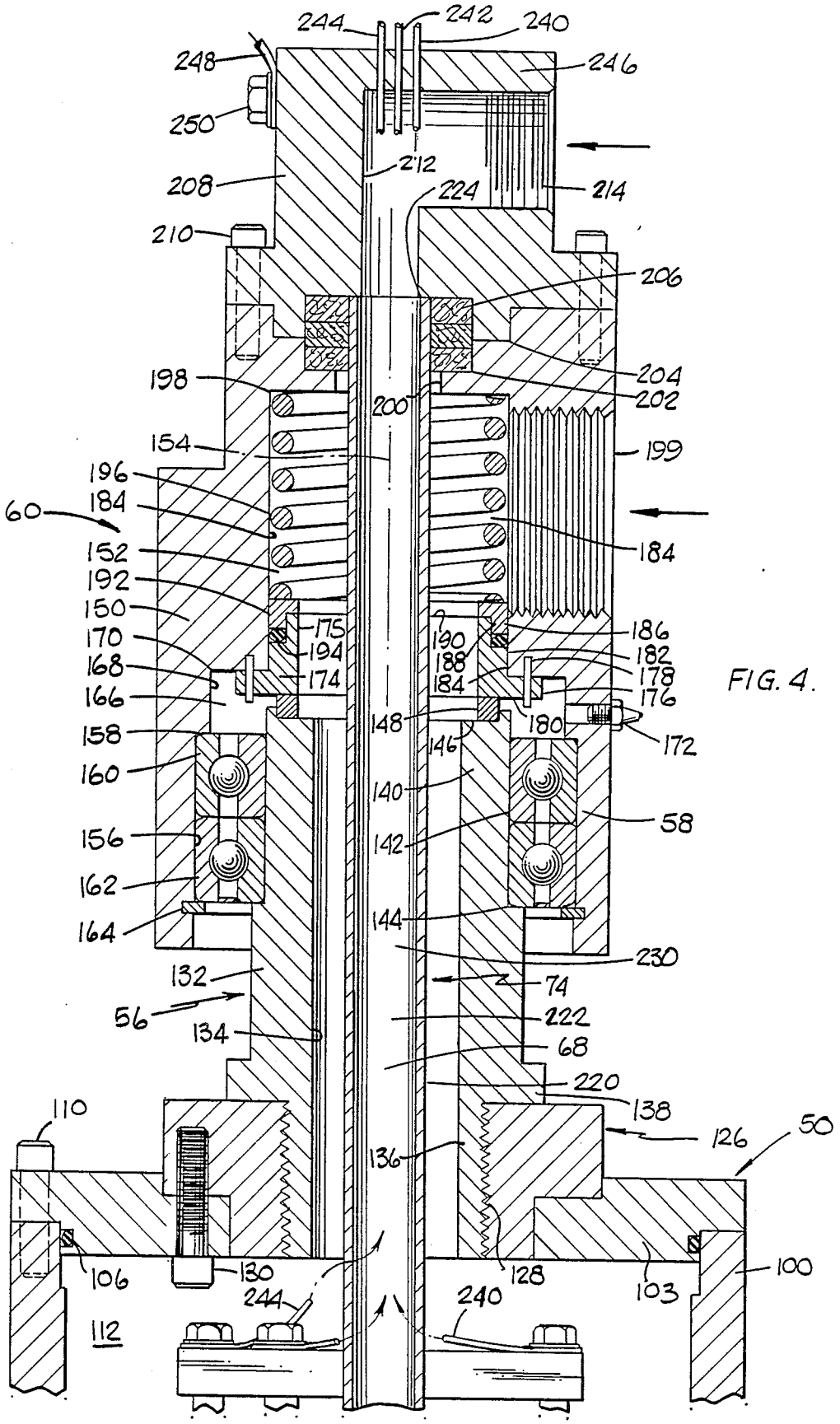
FIGS. 4 and 4A are an enlarged cross-sectional view of the fluid dispensing system.
Figure 4A:
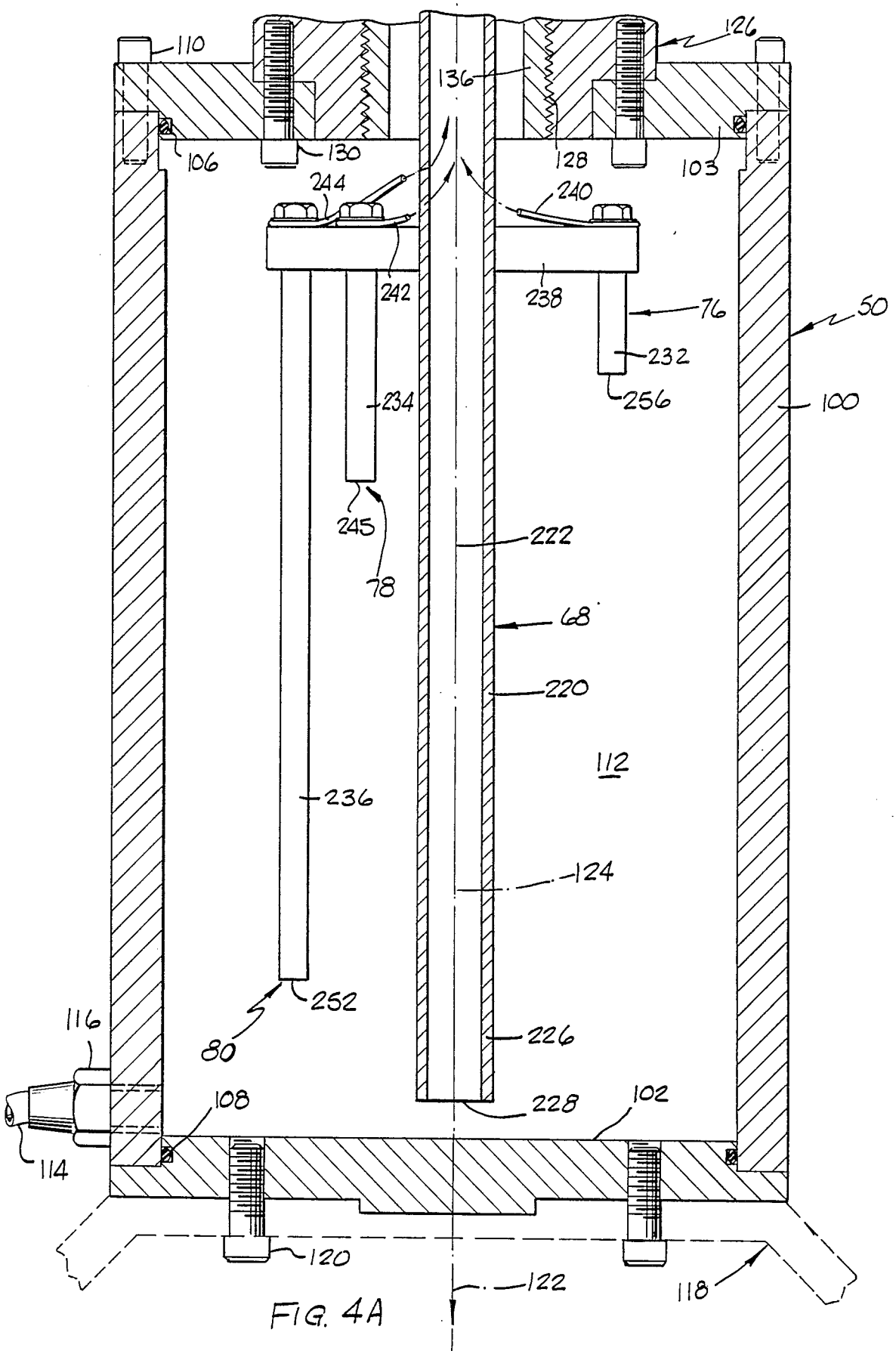

As shown in FIG. 4A, sealant supply chamber means 50 comprises a cylindrical member 100 having an annular lower end plate 102 and an annular upper end plate 103 which are sealably connected to member 100 by O-ring seal members 106, 108 and a plurality of suitable threaded fastener means as illustrated at 110 to provide an elongated vertically extending sealant supply chamber 112. The components of supply chamber means are made from a non-corrosive material such as stainless steel. One or more conventional sealant supply hose means 114 are connected to a lowermost portion of chamber 112 by a plurality of circumferentially-spaced coupling-passage means 116 located adjacent the lower end wall 102. Lower end wall member 102 is sealably fastened to a support bracket means 118 by suitable non-corrosive sealing material and threaded fastener means as illustrated at 120. Support bracket means 118 is fixedly connected to the bracket and hub means 30 of the sealant applying machine, as illustrated at 34 in FIG. 2, for rotation therewith about central axis 122 which is coaxial with central axis 124 of supply chamber mean 50. A coupling collar means 126 having a central threaded passage 128 is suitably sealably mounted on upper end plate 103 by a plurality of suitable threaded fastening means 130.

Spindle means 56 comprises an elongated spindle member 132 having a central passage 134 which is coaxial with the axis of rotation 122. The lower spindle end portion 136 is sealably threadably mounted in threaded passage 128 with a flange portion 138 seated on collar member 126. A bearing journal means is provided on the upper end portion 140 by annular surface 142 and a shoulder 144. A counterbore 146 is provided on the upper end surface to receive a rotating sealing ring member 148 made of carbon material.

Support housing means 60 comprises a conventional non-rotatable annular support housing member 150 having a central passage 152 with a central axis .154 coaxial with the axis of rotation 122. A counterbore at the lower housing end portion provides bearing journal means in the form of an annular surface 156 and a shoulder 158 for supporting bearing means 160, 162 which are retained by a snap ring member 164.

The sealing means comprises an annular seal lubricant chamber 166 provided by an annular counterbore surface 168 and shoulder surface 170. An FDA qualified grease-type lubricant is supplied to chamber 166 through a suitable grease fitting 172. Chamber 166 is sealed by a conventional precision-ground, non-rotatable annular collar-type member 174 made of ceramic material having a straight central passage 175 and a flange portion 176 which abuts shoulder surface 170 and is non-rotatably secured to member 150 by suitable pin means 178 which enable axial displacement. The lower collar surface 180 sealingly engages rotatable seal ring member 148. An intermediate annular collar surface 182 is supported in close fitting engagement on annular housing surface 184. A conventional L-shape annular spring abutment ring member 186 is mounted in annular groove 188 on the upper collar end portion and seated against the collar end surface 190 with the annular peripheral surface 192 thereof in close fitting engagement with housing surface 184. A conventional sealing ring member 194 is sealably mounted between and engageable with abutment ring 186, collar member 174 and housing surface 184. A conventional compression spring means 196 is mounted between abutment ring 186 and a housing shoulder 198 along housing surface 184 to exert a downward force on the sealing members.

The support housing means further comprises an annular threaded air inlet passage 199 which intersects passage 184 between ring 186 and upper surface 198. The upper end portion of housing member 150 has relatively small diameter central passage 200 and counterbores 202, 204 to receive an annular compressible sealing means 206 and a cap member 208 which is fastened to housing member 150 by a plurality of suitable threaded fastening means illustrated at 210. Cap member 208 has a central vertical sealant passage 212, which is coaxial with rotational axis 122, and a transverse threaded passage 214 for receiving a supply line coupling means.

Sealant passage means 68 comprises an elongated tubular member 220 made of a non-corrosive material such as plastic or stainless steel and having a central passage 222 which is coaxial with central chamber axis 124. Upper end portion 224 is fixedly secured in abutting engagement with cap member 208 by compressive retaining engagement with sealing means 206 in coaxial alignment with passage 212 which is of smaller diameter than passage 222 to facilitate flow of sealant thereto. The lower end portion 226 has a sealant discharge opening 228 located closely adjacent the lower end wall 102. The outside diameter of tube member 220 is substantially less than the inside diameter of passage 134 to provide an annular air passage 230 therebetween.

Sensing means 76, 78, 80, FIG. 3, comprise elongated relatively thin variable length plate members 232, 234, 236 which are suspended in sealant chamber 112 by a support bridge member 238 fixedly attached to sealant tube member 220. The plate members are made of an electrically conductive material such as stainless steel which is preferred because of non-corrosive characteristics. Each plate member is connected to suitable electrical wire lead means 240, 242, 244 which extend into tube passage 222 through suitable sealed passages and upwardly in passage 222 through cap passage 212 and cap end wall 246 for connection to electrical control means 74. A ground wire 248 is connected to cap member 208 at 250 so as to provide a ground circuit throughout the apparatus including the side wall of sealant chamber member 100. Lower end portion 252 of sensor 236 is located above the sealant discharge opening 228 to establish a minimum level of sealant whereat the chamber 112 will be refilled with sealant. As long as a circuit is completed through the side wall 100, the conductive compound material, and fill sensor blade 236, the sealant delivery system is inoperative. When the circuit is broken by absence of compound, the sealant delivery system is activated. Lower end portion 245 of fill sensor 234 is located in an upper portion of chamber 112 to establish a maximum level of sealant whereat the supply of sealant to chamber 112 will be discontinued when sealant engages sensor 234. The lower end portion 256 of sensor 232 is located above maximum level sensor 234 to prevent overfilling in the event of any failure of sensor 234.

In operation, sealant is periodically pumped into chamber 112 under suitable pressure, e.g., 50 psig., to maintain a supply of sealant between the maximum and minimum levels by operation of pump means 64 and solenoid valve means 66 which positively closes the sealant passage after sufficient sealant has been delivered to chamber 112 to prevent escape of air and assure proper pressurization of the chamber. Pressurized air is continuously supplied to the upper portion of chamber 112 through pressure regulator means 72 at a suitable pressure, e.g., 45 psig. Air enters chamber 112 through air passage 230 from air inlet chamber 152 in non-rotating housing 150. The bearing sealing means are subject to the air pressure to assist in preventing inward flow of grease from grease chamber 166. Spring means 196 exerts continuous axial force on the sealing means so that rotatable sealing ring member 148 functions to prevent escape of air or inward flow of grease. A corrosive sealant, such as a water-based sealant compound, is completely isolated from the seal means and the bearing means. In addition, the conductivity of the sealant compound is utilized to provide a reliable level sensor system mounted internally of the supply chamber means and extending upwardly through the sealant supply passage means.

The illustrative and presently preferred embodiment of the invention is designed and constructed to enable retrofit of an existing sealant applying machine. Various modifications may be employed to enable usage with other machines of varying design. Thus, it is intended that the appended claims be construed to include modifications and variations except insofar as limited by the prior art.

What is claimed is:

1. A sealant supply system for a sealant applying machine having a plurality of rotatable sealant applying head devices rotatable about a central axis of rotation and comprising:

support means for supporting said system on the machine;

a rotatable sealant supply chamber means mounted on said support means for holding a supply of sealant material and having a bottom wall portion, a side wall portion, and an upper wall portion;

coupling passage means in a lower portion of said chamber means for connection to the sealant applying head devices to supply sealant thereto;

a spindle means mounted on said upper wall portion of said chamber means for enabling rotation of said chamber means;

a first central passage means in said spindle means enabling supply of air and sealant to said chamber means;

bearing journal means and bearing means on an outer wall portion of said spindle means for rotatably supporting said spindle means;

a non-rotatable housing means for receiving and rotatably supporting said bearing means and said spindle means;

a second central passage means in said non-rotatable housing means for connection to said first central passage means for enabling supply of air and sealant to said chamber means;

passage sealing means between said spindle means and said housing means for sealing said first central passage means relative to said second central passage means;

a sealant delivery tube means mounted in said first central passage means and said second central passage means and having a discharge opening located in said chamber means for supplying sealant to said chamber means; and air passage means circumjacent said tube means and defined by said tube mean and said first central passage means and said second central passage means for supplying pressurized air to said chamber means.

2. The invention as defined in claim 1 and further comprising:

sealant level sensor means mounted in said chamber means for controlling the supply of sealant to said chamber means.

3. The invention as defined in claim 2 and wherein said sensor means comprising:

a low level sensor means for causing delivery of sealant to said chamber means when a predetermined low level of sealant is sensed; and a maximum level sensor means for terminating delivery of sealant to said chamber means when a predetermined maximum level of sealant has been delivered to said chamber means.

4. The invention as defined in claim 3, and wherein said sensor means further comprising:

a pair of variable length elongated plate members mounted in said chamber means for engagement with sealant material therein and generation of a control signal by contact therewith;

electrical wire connecting means connected to each of said plate members for receiving and transmitting control signals generated thereby and controlling delivery of sealant to said chamber means.

5. The invention as defined in claim 4 and wherein said electrical wire connecting means extend upwardly through said tube means.

6. The invention as defined in claim 1 or 5 and wherein said sealing means comprising:

non-rotatable sealing ring means mounted on one of said spindle means and said housing means; and a rotatable sealing ring means mounted on the other one of said spindle means and said housing means.

7. The invention as defined in claim 6 and wherein said sealing means further comprising:

spring means mounted in said central passage means in said housing means for an axially directed sealing force on said non-rotatable sealing means and said rotatable sealing ring means.

8. The invention as defined in claim 7 and further comprising:

an annular lubricant supply chamber means being located circumjacent said sealing means and axially adjacent said bearing means for supplying lubricant to said rotatable sealing means and said bearing means.

9. The invention as defined in claim 8 and further comprising:

an air inlet passage means in said housing means located axially opposite said spring means for supplying air to said second central passage means above said sealing means.

10. The invention as defined in claim 9 and further comprising:

said tube means having an upper end portion located above said spring means and said air inlet passage means; and sealant inlet passage means located above said upper end portion of said tube means for delivering sealant thereto.

11. The invention as defined in claim 10 and wherein:

said first central passage means and said second central passage means and said spindle means and said tube means and said housing means being coaxial with said central axis of rotation.

12. The invention as defined in claim 11 and further comprising:

an upper end cap means mounted on said housing means for supporting the upper end portion of said tube means; and sealing means associated with said upper end portion of said tube means and said end cap means for sealing the upper end portion of said second central passage means.

* * * * *